United States Patent [19]

Lehman

[11] 4,305,316

[45] Dec. 15, 1981

[54] WRENCH COUPLING DEVICE

[76] Inventor: James F. Lehman, 21180 W. Toledo St., Williston, Ohio 43468

[21] Appl. No.: 93,880

[22] Filed: Nov. 13, 1979

[51] Int. Cl.[3] ..... B25B 13/58

[52] U.S. Cl. ..... 81/180 R; 81/53 R

[58] Field of Search ..... 81/53 R, 53 A, 57.34, 81/57.36, 64, 65, 177 R, 177 A, 180 R, 184

[56] References Cited

U.S. PATENT DOCUMENTS

| | | | |
|---|---|---|---|
| 443,312 | 12/1890 | Bode | 81/53 R |
| 2,737,839 | 3/1956 | Paget | 81/53 R |
| 3,122,952 | 3/1964 | Eliason | 81/57.34 X |
| 3,288,001 | 11/1966 | Laird, Jr. | 81/53 R X |
| 3,752,016 | 8/1973 | Ballard | 81/64 |
| 3,880,024 | 4/1975 | Asada | 81/57.34 |

*Primary Examiner*—James G. Smith

*Attorney, Agent, or Firm*—Wilson, Fraser, Barker & Clemens

[57] ABSTRACT

A device which facilitates the connection and disconnection of threaded members includes a first handle receiving collar secured at the end of an elongate member and a second handle receiving collar which is slidably and rotatably disposed on the elongate member. A first wrench is appropriately positioned on one of the threaded members and the first collar is positioned about the handle of the first wrench. In a similar manner, a second wrench is appropriately positioned on the threaded members and the slidable collar is positioned about its handle. Force is then applied to the elongate member of the device and the threaded members are expeditiously connected or disconnected.

8 Claims, 3 Drawing Figures

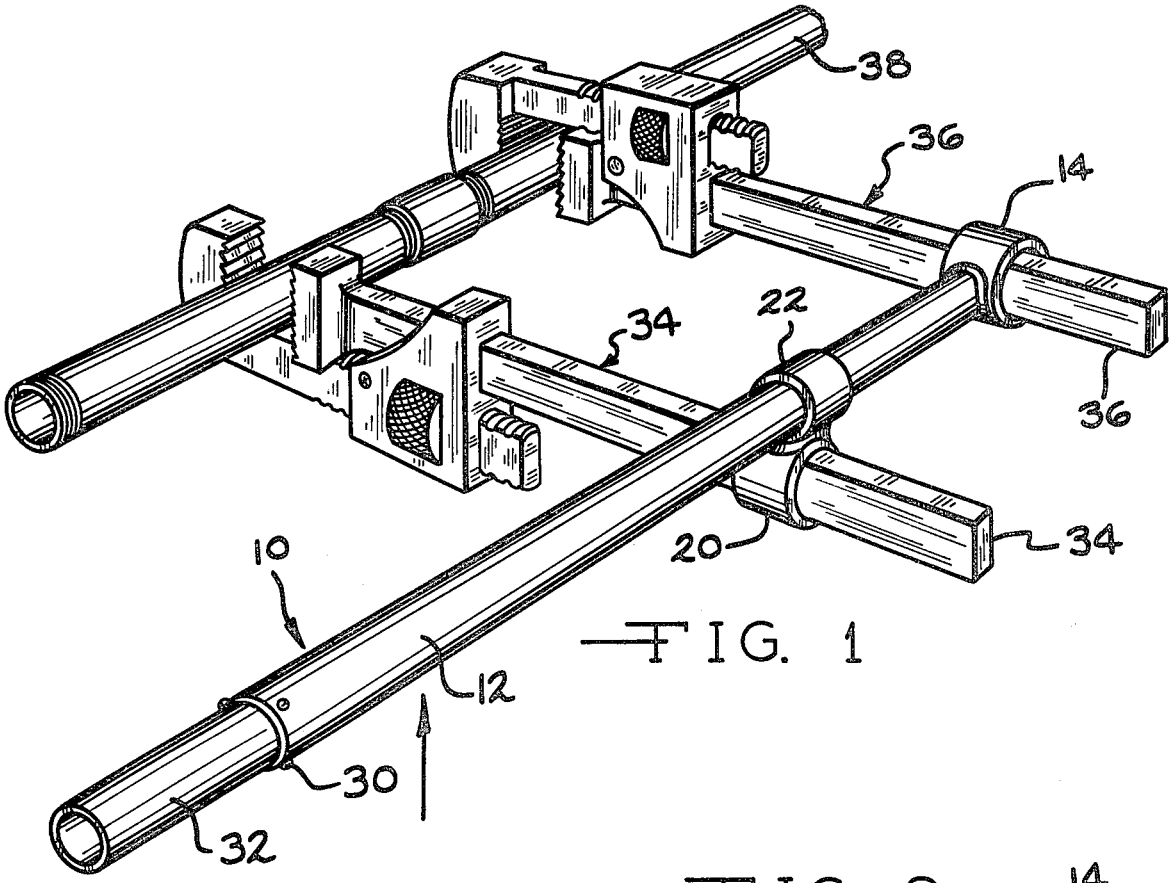
FIG. 1
FIG. 2
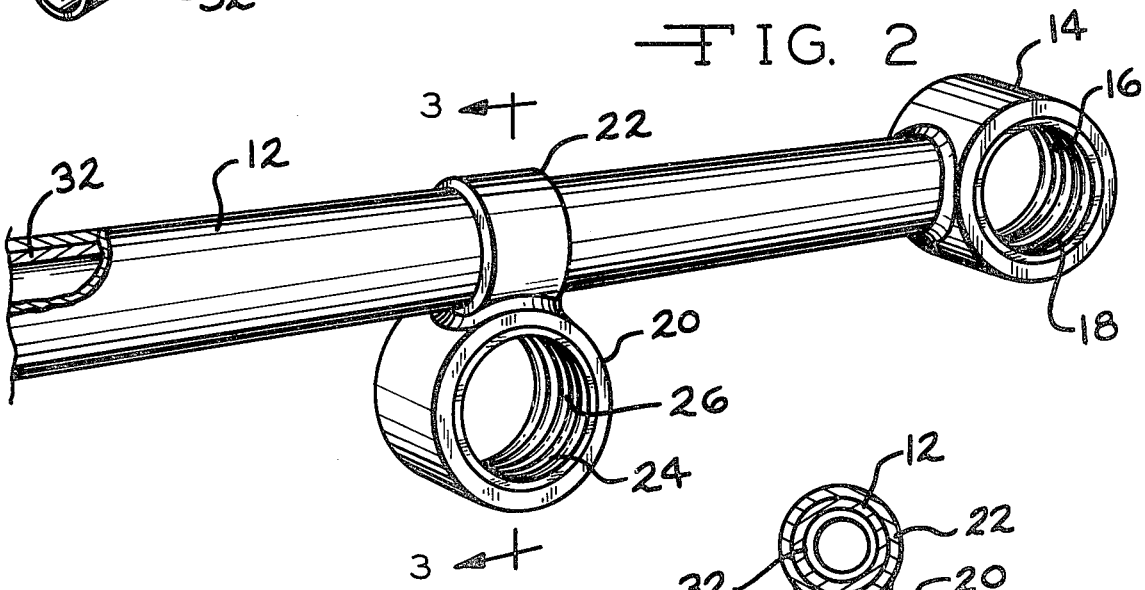
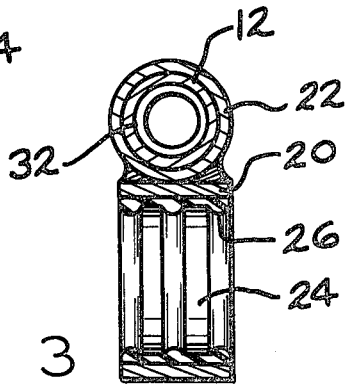
FIG. 3

WRENCH COUPLING DEVICE

BACKGROUND OF THE INVENTION

The invention relates generally to hand tools and more specifically to a device which affixes to the handles of two wrenches and assists in the connection or disconnection of threaded members.

Those wrenches generally denominated pipe wrenches, having a pair of loosely adjustable jaws which include oppositely angled saw teeth on opposed faces, are the basic tool of the plumber and are a staple of most handymen's tool kits. The jaws may be adjusted to accept a given diameter of pipe and the saw teeth bit into and grip the generally smooth surface of the pipe in order to accomplish torque transfer to the pipe and rotate same.

Whereas a single pipe wrench is sufficient to remove a fitting or pipe from a fixed and rigid fitting or plumbing system, such a condition is infrequently experienced and in the majority of cases, pipe wrenches must be utilized in pairs: one wrench being utilized to restrain a pipe fitting from rotation while the second wrench is utilized to tighten or loosen a second fitting. Such an operation, though commonly encountered, is not without difficulty inasmuch as it generally necessitates applying force in opposite directions, i.e., pushing with one hand on one wrench handle while pulling with the other hand on the other wrench, thus effectively reducing by one-half the total force which one might exert on either of the wrenches individually. Furthermore, if the operator is careless, forces on the two wrenches may not be equal and the pipe or fitting which it was desired to maintain stationary may move due to this force inequality.

An explanation of the operation is also a statement of the problem: two separate and independent tools are being manipulated to perform what is in fact a single operation.

A review of the prior art directed to the solution of this paradox reveals that few people have so defined the problem and directed their efforts to its solution. U.S. Pat. No. 3,122,952 discloses a wrench winch of notable complexity which is intended to assist the utilization of two pipe wrenches in the above described manner.

SUMMARY OF THE INVENTION

The wrench coupling device of the instant invention is a simple and elegant solution to the problem of utilizing two wrenches to connect or disconnect threaded members. The device comprises an elongate member having a collar or socket disposed transversely at one end which accepts the handle of one pipe wrench. A second collar of preferably equivalent size and internal diameter is slidably and rotatably disposed on the elongate member and accepts the handle of a second pipe wrench. The elongate member may be of a telescoping nature, that is, include an internal extensible second elongate member to increase obtainable leverage and thus the force which one may exert on the pipe wrenches. Preferably there is also included a stop means at the end of the elongate member opposite the first collar to prevent the rotatable and slidable second collar from dislodging from the elongate member and becoming lost. In use, the two wrenches are positioned on the two threaded members to be connected or disconnected, with their handles disposed approximately in a radial plane extending from the axis of the members.

The collars of the wrench coupling device are positioned about the handles of the wrenches. Force is applied to the elongate member, through the wrenches and to the threaded members to turn and thus connect or disconnect them. Obviously, if additional force is required, the telescoping sections of the elongate member may be extended and be utilized to increase the force applied to the pipe fittings.

It is thus an object of the instant invention to provide a device which facilitates the use of two wrenches to connect or disconnect threaded members.

It is a further object of the instant invention to provide a simple, durable and inexpensive device which may be utilized in the aforesaid manner.

It is a still further object of the instant invention to provide a device which assists in the equal application of force to two wrenches applied to adjacent threaded components.

It is a still further object of the instant invention to provide a device having extensible lever means for increasing the force applied to threaded components which it is desired to connect or disconnect.

Further objects and advantages of the instant invention will become apparent by reference to the following specification and attached drawings.

BRIEF DESCRIPTION OF THE DRAWINGS

FIG. 1 is a perspective view of a wrench coupling device according to the instant invention in place on two pipe wrenches which are in turn positioned on pipe fittings which are desired to be separated;

FIG. 2 is an enlarged fragmentary perspective view of a wrench coupling device according to the instant invention; and FIG. 3 is a full sectional view of a sliding collar utilized in a wrench coupling device according to the instant invention.

DESCRIPTION OF THE PREFERRED EMBODIMENT

Referring to FIGS. 1 and 2, a wrench coupling device according to the instant invention is generally designated by the reference numeral 10. The wrench coupling device 10 includes a generally elongate, hollow member 12 which may be fabricated of steel or other material having suitable high strength and includes a generally circular ring or collar 14 secured at one end. The collar 14 defines a passageway or opening 16. The opening 16 is preferably circular in nature and of sufficient diameter to fit about the handle of a wrench. The inner surface of the opening 16 preferably includes a ribbed and/or resilient liner or bushing 18 which is utilized to improve the purchase of the collar 14 and generally the device 10 on the handle of a wrench.

The device 10 further includes a second ring or collar 20 which is slidably and rotatably mounted upon the elongate member 12 by means of a loosely fitting collar 22. The collar 20 likewise defines an opening 24 which is preferably circular. The opening 24 is disposed generally transversely to the axis defined by the elongate member 12 and the bushing 22 and thus it may be positioned such that its axis is parallel to that of the opening 16. The collars 14, 20 and 22 may be fabricated of any suitable material such as steel and the collars may be integrally formed with their associated members, i.e., the elongate member 12 with the collar 14 and the collar 20 with the collar 22, or these components may be secured to one another subsequent to their forming by weldments or other suitable connection means. The collar 20 also includes a ribbed and/or resilient liner or bushing 26 which is intended to improve the purchase of the collar 20, and generally the device 10, upon the handle of a second wrench.

Referring briefly to FIG. 3, the collar 20 and liner 26 as well as the collar 22 and elongate member 12 are illustrated in cross section. Both of the liners 18 and 26 are preferably fabricated of a tough but resilient material such as rubber, polyethylene or polyurethane and, as explained, improve the purchase of the device 10 on wrench handles. The ribbings or convolutions illustrated should be considered to be one of a number of treatments which may be utilized on the inner surface of the liners 18 and 26 and thus the invention should not be construed to be limited thereby.

Referring again to FIG. 1, the elongate member 112 also includes a stop structure 30 extending outwardly from the surface of the member 12 adjacent its end opposite the collar 14. The stop structure 30 prevents the collar 22 and thus the collar 20 from sliding off the elongate member 12 and becoming lost. As such, the stop structure may consist of any radially outwardly directed structure such as the weldment beads illustrated, an outwardly swaged or rolled lip adjacent the end of the elongate member 12 or a collar structure secured thereto by suitable semi-permanent fastening means such as a set screw or permanent fastening means such as weldments. The wrench coupling device 10 may also include a second elongate member 32 which is coaxially disposed within the hollow elongate member 12 and which may be extended from and telescoped thereinto. The second elongate member 32 may also be fabricated of any suitable high-strength material such as steel.

The wrench coupling device 10 is utilized with two wrenches. Notwithstanding the fact that the wrench coupling device 10 is illustrated in FIG. 1 in place on two pipe wrenches and furthermore that the subsequent description of operation explains its use only with reference to pipe wrenches, such description is by way of illustrative example only and it should be understood that the wrench coupling device 10 functions equally well with wrenches of other designs and configurations which are being utilized in pairs to connect or disconnect threaded, generally coaxially aligned components. The jaws of first and second pipe wrenches 34 and 36, respectively, are adjusted according to conventional practice to properly grip the components of a piping structure 38 or similar threaded components. The pipe wrenches 34 and 36 are then placed upon the piping components 38, again in accordance with conventional practice, depending upon whether the piping components 38 are to be connected or disconnected. Other types of wrenches, such as adjustable, open end or box end which would be used with the device 10 in non-plumbing applications are not direction sensitive and may be positioned on the workpieces without regard to their direction of torque application. In FIG. 1, the wrenches 34 are positioned to loosen or disconnect the piping components 38. Next, the opening 16 of the collar 14 is slid upon the handle of the pipe wrench 36 and the sliding collar 20 is appropriately adjusted and positioned over the handle of the other pipe wrench 34. Force may then be applied as indicated by the arrow in FIG. 1 and the piping components 38 may be easily loosened and disassembled. If the application of additional torque to the components is required to break an exceptionally tightly connected joint, the second elongate member 32 may be extended from the first elongate member 12 and force applied thereto.

The connection or tightening of piping components 38 or other threaded members is accomplished in a similar manner. The pipe wrenches 34 and 36 are positioned on the components 38 in a manner opposite to that illustrated in FIG. 1 such that the jaw teeth grip the piping components 38 when moved in the direction causing engagement and tightening thereof.

The foregoing disclosure is the best mode devised by the inventor for practicing this invention. It is apparent, however, that devices incorporating modifications and variations to the instant invention will be obvious to one skilled in the pertinent art. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What I claim is:

1. A device for use with two wrenches for facilitating connection and disconnection of threaded members comprising, in combination, an elongate member defining an axis, first means secured to said member for slidingly receiving a handle of a first wrench along an axis substantially normal to said elongate member axis, first collar means for slidable positioning about said elongate member and a second collar means secured to said first collar means for engaging a handle of a wrench.

2. The device of claim 1 further including stop means disposed adjacent an end of said elongate member for limiting travel of said second means between said first means and said stop means.

3. The device of claim 1 wherein said first means is a collar defining an opening disposed substantially normal to said axis of said elongate member.

4. The device of claim 1 wherein said first and said second collar means are disposed substantially normal to one another.

5. The device of claim 1 further including a second selectively extendable and retractable elongate member disposed coaxially with said first elongate member.

6. A wrench coupling device comprising, in combination, an elongate member defining an axis and a region of substantially constant diameter, said elongate member having a first collar secured thereto, said first collar defining an opening having an axis, said member axis and said collar axis being disposed substantially perpendicularly to one another, and a second collar having mounting means for slidably positioning said second collar on said region of substantially constant diameter of said elongate member, said mounting means defining an axis substantially coincident with said axis of said elongate member, said second collar defining an opening having an axis disposed substantially perpendicularly to said axis of said mounting means.

7. The device of claim 6 further including a cushioning liner disposed within said collar openings.

8. The device of claim 6 further including stop means adjacent the end of said region of substantially constant diameter most distant said first collar for limiting travel of said second collar between said first collar and said stop means.

* * * * *